US010912339B2

(12) United States Patent
Steiner

(10) Patent No.: US 10,912,339 B2
(45) Date of Patent: Feb. 9, 2021

(54) DEVICE FOR PRODUCING AND INHALING SMOKE

(71) Applicant: Alexander Steiner, Regensburg (DE)

(72) Inventor: Alexander Steiner, Regensburg (DE)

( * ) Notice: Subject to any disclaimer, the term of this patent is extended or adjusted under 35 U.S.C. 154(b) by 238 days.

(21) Appl. No.: 16/044,204

(22) Filed: Jul. 24, 2018

(65) Prior Publication Data

US 2019/0307167 A1 Oct. 10, 2019

(30) Foreign Application Priority Data

Apr. 6, 2018 (DE) ..... 10 2018 108 186
Apr. 6, 2018 (DE) ..... 10 2018 108 187

(51) Int. Cl.
*A24F 47/00* (2020.01)
*A24F 7/00* (2006.01)

(52) U.S. Cl.
CPC ..... *A24F 47/008* (2013.01); *A24F 7/00* (2013.01)

(58) Field of Classification Search
None
See application file for complete search history.

(56) References Cited

U.S. PATENT DOCUMENTS

2018/0228211 A1* 8/2018 Eckhoff ..... A24F 1/00
2019/0246691 A1* 8/2019 McCoy ..... A24D 1/14

OTHER PUBLICATIONS

Office Action dated Nov. 27, 2018, for German Application No. 10 2018 108 187.1.
Cited Document in above-referenced Office Action, for German Application No. 10 2018 10 187.1.

* cited by examiner

*Primary Examiner* — Michael H. Wilson
*Assistant Examiner* — Katherine A Will
(74) *Attorney, Agent, or Firm* — Michael J. Gallagher, Esq.; Luper Neidenthal & Logan

(57) ABSTRACT

The invention relates to a device for producing and inhaling smoke, in particular to e-cigarettes for producing and inhaling smoke, comprising at least two chambers that are each designed and intended for receiving a smoking product, for example tobacco or a liquid to be vaporised. The device further comprises at least one means for receiving smoke formed inside the chambers, the means being fluidically connected to the two chambers and also to a mouthpiece for inhaling the smoke. In this case, the means for receiving smoke comprises at least one adjustment mechanism, a through-flow cross section with respect to each chamber and/or with respect to the mouthpiece being adjustable by means of the adjustment mechanism. As a result, either, one of the two smoking products can be inhaled by a user as desired, or both smoking products can be inhaled at the same time.

20 Claims, 2 Drawing Sheets

DEVICE FOR PRODUCING AND INHALING SMOKE

The present invention relates to a device for producing and inhaling smoke, in particular an e-cigarette for producing and inhaling smoke according to the preamble of claim 1.

Previous devices for producing and inhaling smoke, including previous e-cigarettes, only allow one flavour to be inhaled at a time. This is due, inter alia, to the fact that previous e-cigarettes provide only one mounting for accommodating only one tank in which the smoking product, for example a liquid to be vaporised, is located.

However, this has the disadvantage that the user is restricted to only one flavour of smoking product. Although the flavour can be changed, in an e-cigarette known from the prior art, by separately exchanging single tanks of this type, this is particularly laborious and expensive for the user.

The present invention therefore aims to overcome the above-mentioned problem, and therefore the object of the present invention is that of providing a device for producing and inhaling smoke, in particular an e-cigarette for producing and inhaling smoke, which makes it possible to provide, in a particularly simple, cost-effective and customised manner, different flavours without separately exchanging a smoking product chamber. This object is therefore achieved by the subject matter of claim 1. In particular, the device for producing and inhaling smoke according to the invention, in particular the e-cigarette for producing and inhaling smoke proposed herein, comprises at least two chambers that are each designed and intended for receiving a smoking product, for example tobacco or a liquid to be vaporised.

The device further comprises at least one means for receiving smoke formed inside the chamber, the means being fluidically connected to the two chambers and also to a mouthpiece for inhaling the smoke.

A key element of the present invention is that the means for receiving smoke comprises at least one adjustment mechanism, a through-flow cross section with respect to each chamber and/or with respect to the mouthpiece being adjustable by the adjustment mechanism, such that, either, one of the two smoking products can be inhaled by the user as desired, or both smoking products can be inhaled at the same time.

The adjustment mechanism can be a gripping surface that is arranged on the mouthpiece or on the means for receiving smoke, for example.

The aforementioned means for receiving smoke thus makes it possible, via the adjustment mechanism described herein, for different flavours to be inhaled consecutively or simultaneously. The present device for producing and inhaling smoke thus makes it possible to offer the user customised flavours without the need to exchange the smoking product in order to change the flavour.

The chambers are preferably arranged in the manner of a magazine about a longitudinal axis of symmetry in the longitudinal direction, i.e. in a direction that is in parallel with the main extension direction of the device. For example, the means for receiving smoke can be adjusted, but in particular rotated about the longitudinal direction, by actuating the adjustment mechanism, such that a through-flow cross section completely closes or is completely closed with respect to a for example fixed chamber, while a through-flow cross section is completely open with respect to the second chamber. Intermediate positions (open at least in part and/or closed at least in part) are also conceivable. Only one smoking product is inhaled, for example.

However, it is alternatively also conceivable for the through-flow cross sections of both chambers to be completely open or open at least in part, for example. A mixture of the vapours of the two smoking products, which are inhaled together through the single mouthpiece, can therefore be brought about by the means for receiving smoke formed inside the chamber.

In this case, "through-flow cross section" describes, with respect to each chamber, a cross section inside a channel system that is associated with the chamber or arranged inside the chamber and that leads to a mouthpiece of the device.

According to at least one embodiment, the device for producing and inhaling smoke, in particular an e-cigarette for producing and inhaling smoke, comprises at least two chambers that are each designed and intended for receiving a smoking product, for example tobacco or a liquid to be vaporised. In this case, the device also comprises at least one means for receiving smoke formed inside the chambers, the means being fluidically connected to the two chambers and thus also to a mouthpiece for inhaling the smoke.

According to the invention, the means for receiving smoke comprises at least one adjustment mechanism, a through-flow cross section with respect to each chamber and/or with respect to the mouthpiece being adjustable by means of the adjustment mechanism, such that, either, one of the two smoking products can be inhaled by a user as desired, or both smoking products can be inhaled at the same time.

According to at least one embodiment, the two chambers are installed in a housing that is in particular portable, and the two chambers are arranged adjacently to one another in a direction that is perpendicular to the longitudinal direction. In this case, each chamber is fluidically connected to the mouthpiece by means of a channel system which is in particular blockable at least in part.

In particular, at least one channel system, but preferably each channel system, can be blocked at least in part by the means for receiving smoke formed inside the chamber, as a result of which the above-mentioned choice of flavours for the user can be achieved.

The housing is a housing of an e-cigarette for producing and inhaling smoke, for example. The portable housing specified here is designed and intended to be utilised by a user, in particular manually. In this respect, the housing proposed here can be clearly distinguished from a permanently installed housing on account of its dimensions. In other words, all other components, such as a battery or an electronically operated heating system for heating the smoking product of the device, are preferably installed in the housing. Therefore, no other element for operating the device for producing and inhaling smoke is arranged outside the housing.

The housing is furthermore a closed housing which is, however, reclosable, in particular for refilling the chambers and/or for exchanging the chambers.

According to at least one embodiment, the mouthpiece comprises at least two openings into which one channel system leads in each case, such that the preferably blockable fluidic connections are formed by the openings.

At least one opening, and preferably both openings, can be designed in the form of a hole in a side wall of the mouthpiece. For example, the mouthpiece is designed as a hollow cylinder and is open at the top surface and at the base, a side face having at least one opening.

Additionally or alternatively, a valve apparatus for controlling or regulating a through-flow cross section of the opening can be arranged in or on at least one opening. A valve of this type can be designed as a flap valve, for example. For this purpose, it is conceivable for a flexible diaphragm to be attached to an inner wall of the mouthpiece or to an outer wall of the mouthpiece, which diaphragm opens at least in part when inhalation takes place, and immediately automatically closes after inhalation has taken place or when exhalation takes place into the mouthpiece in error.

A valve apparatus of this kind is preferably also attached such that it closes automatically when the mouthpiece is rotated about the longitudinal direction in order to adjust the through-flow cross section and/or select a flavour. In this context, it is conceivable for a valve apparatus of this type to be opened or openable in only one specified rotation position relative to the housing and with respect to the longitudinal direction.

According to at least one embodiment, the two chambers are arranged one above the other in the longitudinal direction, each chamber being fluidically connected or connectable to the mouthpiece by means of a channel system, which is in particular blockable at least in part.

According to at least one embodiment, the above-mentioned channel systems are formed on or in a common cover element, the cover element being able to be releasably mounted on the housing.

A cover element of this kind may be integral, such that the cover element is free of screws, rivets or interruptions. For example, the cover element is made of a plastics material. However, it is also conceivable for the cover element to be made of a metal, preferably an antiseptic metal. In particular, the common cover element can be washable, and also reusable.

The cover element can be designed in the form of a screw cap, a wall thickness of the cover element in particular being designed, with respect to both a side face of the cover element and a top surface of the cover element, such at least two channels are formed therein or thereon. In each case one channel is therefore provided for establishing a fluidic connection, associated to said channel in each case, to one chamber. The number of channels is identical to the number of chambers, for example.

According to at least one embodiment, the cover element comprises at least one hole which is continuous in the longitudinal direction, and in which the mouthpiece can be placed such that the mouthpiece protrudes out of the hole in the cover element in the longitudinal direction at least in part, the channel systems in particular leading into a side face of the hole such that a hole in the cover element can be made to overlap, at least in part, with one opening in the mouthpiece in each case, so as to make it possible to establish at least one continuous fluidic connection to each chamber and to the mouthpiece.

The continuous hole is preferably designed in a top surface of the cover element. The hole can be arranged centrally with respect to the longitudinal direction.

The cover element is for example a screw cap comprising an internal thread, and/or is a snap-on cap. A side face of the cover element comprises a projection, for example, that can interlock with another projection of the housing so as to form a releasable closure.

According to at least one embodiment, at least one channel system leads into the mouthpiece laterally, i.e. in a direction transverse to the longitudinal direction.

It is conceivable for the two chambers to be interconnected in the housing by means of a connection apparatus such that the two chambers can be rotated relative to a housing wall of the housing, in particular can be rotated about the longitudinal direction. The magazine-like arrangement of the chambers about the longitudinal direction, already mentioned above, is thus achieved.

The chambers are for example jointly connected to the housing, or are interconnected via a separate connection apparatus arranged in the housing, such that the chambers can be rotated about the longitudinal axis relative to the housing, in the manner of a revolver, or together with the housing. For this purpose, the device can comprise a rotation mechanism that can be actuated by means of the adjustment mechanism. For example, it may be conceivable in this context for the individual chambers to be arranged inside the housing in the manner of a revolver cylinder which can be rotated about the longitudinal axis relative to a housing wall by means of the rotation mechanism. The individual chambers are then arranged in a revolver cylinder of this type.

It is also conceivable for the device to have a fill-level indicator and/or a fill-level sensor device that measures a fill level of each chamber. If the fill level of a chamber falls below a minimum level, it is conceivable for a shut-off mechanism of the device to automatically interrupt the fluidic connection between the relevant chamber and the mouthpiece. Said shut-off mechanism can be electrically operated by means of the battery of the device. The battery of the device may be the only energy source for the device. A heater for vaporising or heating the smoking product is preferably also operated by means of the battery. The shut-off mechanism comprises a closure element, for example, that retracts the relevant fluid line or completely blocks an end of the fluid line.

According to at least one embodiment, the adjustment mechanism is a mechanical adjustment mechanism, for example an adjustment knob that, when pressed, causes the mouthpiece to rotate about the longitudinal direction and/or causes the cover element to rotate in the longitudinal direction. In the process, the mouthpiece and/or the cover element remain fixed (relative rotation between the two components being produced). The chambers, which are for example arranged in the manner of the revolver cylinder, can also be caused to rotate about the longitudinal axis by means of the adjustment mechanism.

For this purpose, the adjustment knob can be connected to a movement mechanism that can produce the above-mentioned rotations, or at least one rotation.

According to at least one embodiment, the adjustment mechanism comprises an electric motor that causes the mouthpiece to rotate in the longitudinal axis and/or causes the cover element to rotate about the longitudinal axis.

The adjustment mechanism can also cause the above-mentioned rotation of the chambers relative to the housing wall of the housing, for example.

According to at least one embodiment, the device is designed to be portable, in particular having a maximum extension in the longitudinal direction of at most 15 cm, preferably of at most 10 cm, and a maximum width in a direction transverse to the longitudinal direction of at most 6 cm, preferably of at most 4 cm.

The above-mentioned measurements have been designed to be particularly advantageous if the above-described device is portable, as has just been set out.

The present device is described in more detail in the following with reference to an embodiment and to the accompanying drawings.

Individual elements of the invention described here are shown in more detail in schematic/perspective views in each of FIGS. 1 to 4.

Figure 1:
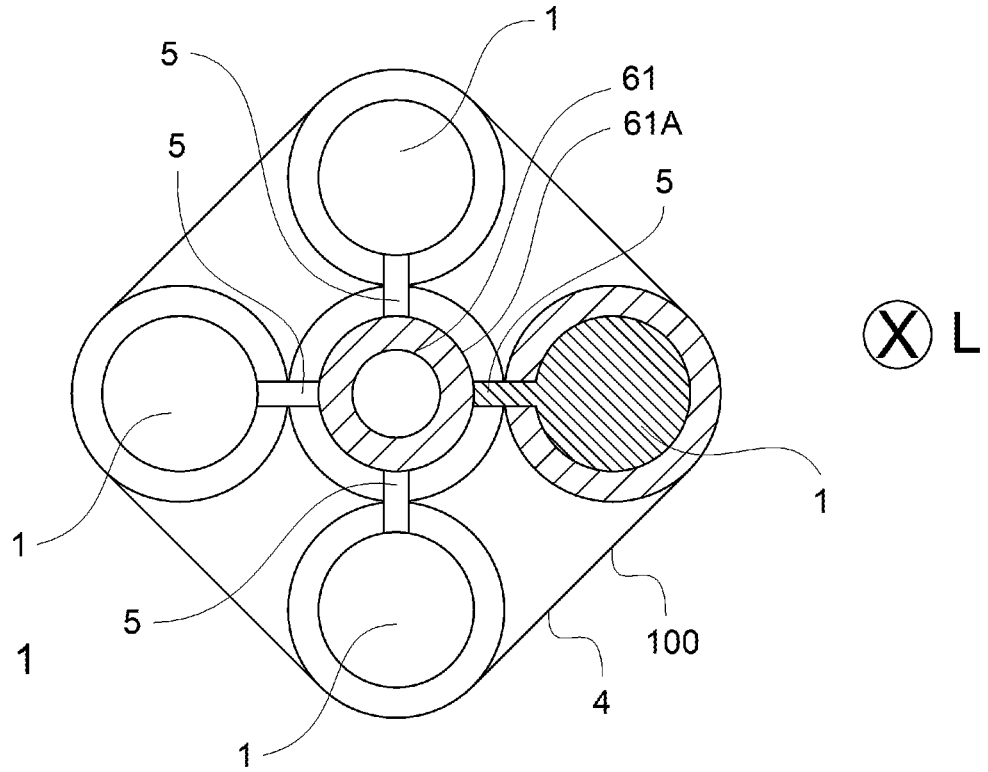
FIG. 1 is a schematic plan view of the device according to the invention.

In the drawings, components that are identical or functionally identical are provided with the same reference signs. The elements shown here should not be considered to be to scale. Instead, the size of some elements may be exaggerated so as to aid understanding.

FIG. 1 is a schematic plan view of a device 100 for producing and inhaling smoke according to the invention and described herein, i.e. an e-cigarette for producing and inhaling smoke set out herein.

As can be seen in FIG. 1, in plan view the device 100 comprises a plurality of chambers 1. Four chambers 1 are in particular visible in plan view. The chambers 1 are arranged about a longitudinal direction L, in the manner of a magazine.

Each of the chambers 1 is designed and intended for receiving a smoking product, in particular a liquid to be vaporised for an e-cigarette, for example.

A means 2 for receiving smoke formed inside the chamber 1 is also shown, the means 2 being fluidically connected to the two chambers 1 and also to a mouthpiece 3 for inhaling the smoke.

The chambers 1 shown in FIG. 1 are installed in a portable housing 4, the two chambers 1 being arranged adjacently to one another in a direction V that extends transversely to the longitudinal direction L, each of the chambers 1 being fluidically connected to the mouthpiece 3, by means of a channel system 5 that can in particular be blocked at least in part.

It can also be seen in FIG. 1 that the mouthpiece 3 comprises a plurality of openings 31 into each of which one channel system 5 leads, such that the fluidic connections are established by means of the opening 31.

Figure 2:
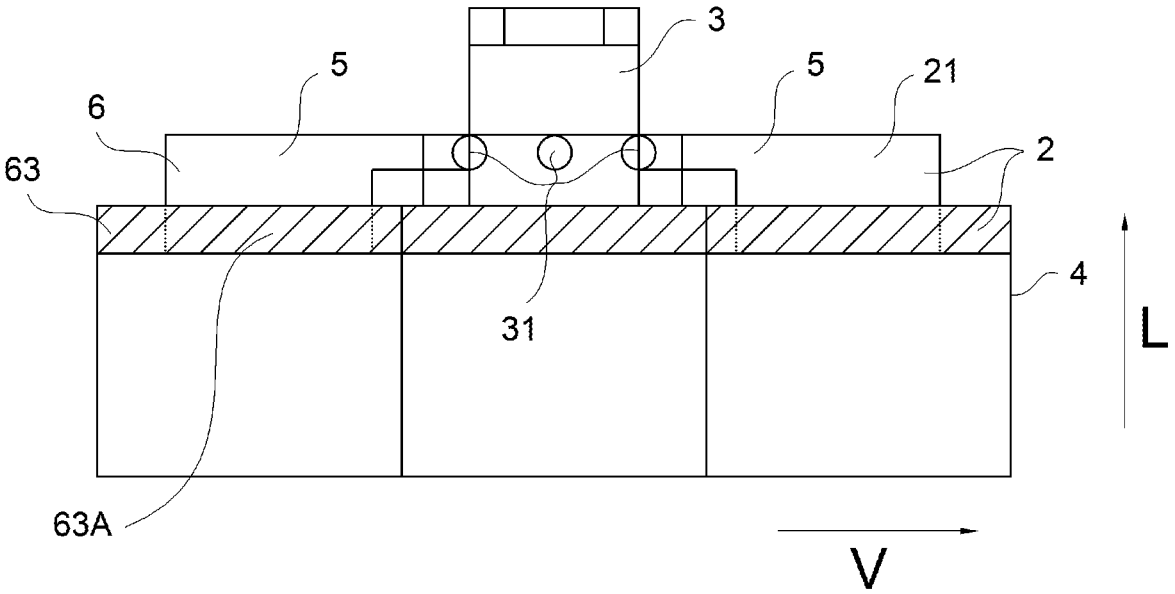
FIG. 2 is a cross sectional side view of the device according to the invention.

Furthermore, FIG. 2 shows a common cover element 6, the cover element 6 being mounted, in particular screwed, on the housing 4, and the channel systems 5 preferably being completely integrated into or onto the cover element 6, in particular into a lateral cover wall of the cover element 6.

The cover element 6 is for example made of a plastics material that has been shaped by means of an injection-moulding process such that the channel systems 5 are, for example, automatically formed inside the cover element 6 by means of a casting process of this type.

Moreover, the cover element 6 comprises a continuous hole 61 in the longitudinal direction L, in which hole the mouthpiece 3 is placed such that the mouthpiece 3 protrudes out of the hole 61 of the cover element 6 in the longitudinal direction, at least in part.

Furthermore, the channel systems 5 can lead into a side face 61A of the hole 61 such that a hole 61 of the cover element 6 can be made to overlap one opening 31 of the mouthpiece 3 in each case, and at least one continuous fluidic connection is established between each chamber 1 and the mouthpiece 3.

As is shown in FIG. 2, however, the channel systems 5 protrude from a base cover 63 in the longitudinal direction L. For this purpose, the channel systems 5 each have a first end that leads into an opening in a chamber 1 in each case and protrudes from the base cover 63 in an upward direction, i.e. in a direction that is in parallel with the longitudinal direction L. The base cover 63 therefore in turn comprises, for each channel system 5, an opening 63A that is continuous in the longitudinal direction L. Said openings 63A are also arranged around the mouthpiece 3, in the base cover 63, in the manner of a magazine.

The base cover 63, together with the channel systems 5, can be rotated relative to the housing 4 in the longitudinal direction L, for example.

The channel systems 5 protrude from the base cover 63 at least in part. As can also be seen in FIG. 2, the openings 31 are arranged above the base cover 63 in the longitudinal direction L.

Figure 3:
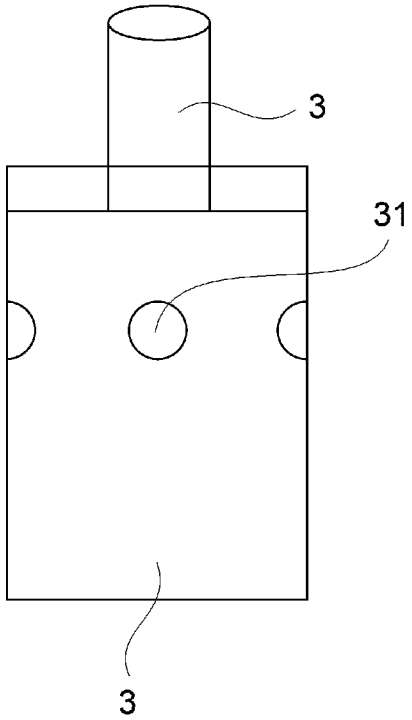
FIG. 3 is a schematic side view of the mouthpiece of the device according to the invention.

FIG. 3 is a schematic side view of a mouthpiece 3 of this type and shows in particular that said openings 31, which are arranged in the peripheral direction of the side wall of the preferably cylindrical casing-like mouthpiece 3, are formed on or in a side wall of the mouthpiece 3.

Figure 4:
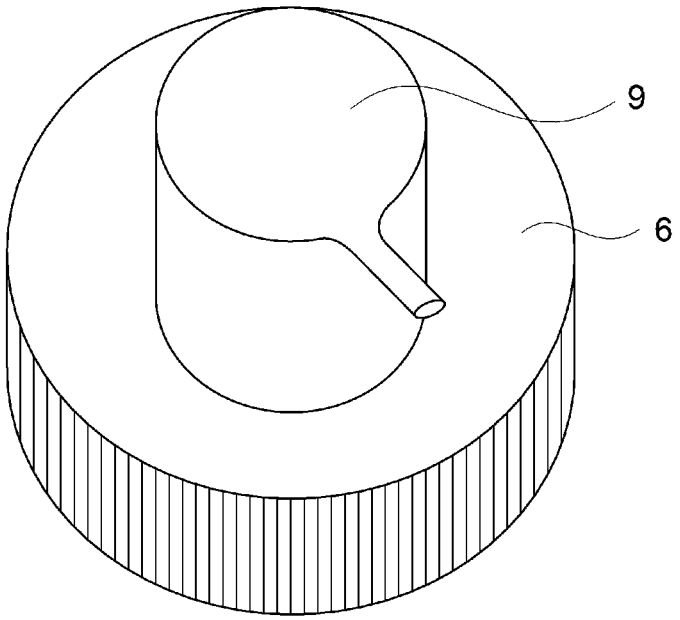
FIG. 4 is a schematic/perspective view of a closure element of the device according to the invention.

FIG. 4 shows a closure element 9 which is preferably releasably attached to a cover element 6. In contrast to FIG. 2, the cover element 6 is designed in this case such that each of the channel systems 5 extend inside the walls of the cover element 6 and are thus completely installed in the cover element 6.

A channel system 5 is for example a channel, preferably a single continuous channel. In particular, if the mouthpiece 3 is removed from the cover element 6, the channel system 5 that opens outwards can be closed by means of the closure element 9 when the overall device 100 is not in use.

The invention is not limited by the description of the embodiment. On the contrary, the invention comprises every new feature and any combination of features, including in particular any combination of the claims, even if said feature or said combination is not itself explicitly specified in the claims or in the embodiment.

LIST OF REFERENCE SIGNS

1 Chamber
2 Means for receiving smoke
3 Mouthpiece
4 Housing
5 Channel system
6 Cover element
9 Closure element
21 Adjustment mechanism
31 Openings
61 Hole
61A Side face
63 Base cover
63A Openings in the base cover
100 Device
L Longitudinal direction
V Direction perpendicular to the longitudinal direction

The invention claimed is:

1. Device for producing and inhaling smoke, in particular an e-cigarette for producing and inhaling smoke, comprising:

at least two chambers, installed in a portable housing, and the two chambers are arranged adjacently to one another in a direction (V) that is transverse to the longitudinal direction (L), each of the chambers being fluidically connected to a mouthpiece, having at least two openings into which one channel system leads in each case, such that fluidic connections are established by means of the openings in a channel system that can be blocked at least in part, that are each designed and intended for receiving a smoking product, for example tobacco or a liquid to be vaporised, at least one means for receiving smoke formed inside the chambers, the means being fluidically connected to the two chambers and also to the mouthpiece for inhaling the smoke, wherein the means for receiving smoke comprises at least one adjustment mechanism, a through-flow cross section with respect to each chamber and/or with respect to the mouthpiece being adjustable by means of the adjustment mechanism, such that, either, one of the two smoking products can be inhaled by a user as desired, or both smoking products can be inhaled at the same time.

2. The device according to claim 1, wherein the channel systems are formed in a common cover element, it being possible for the cover element to be releasably mounted on the housing[41].

3. The device according to claim 1, wherein a cover element comprises at least one hole which is continuous in the longitudinal direction (L) and in which the mouthpiece can be placed such that the mouthpiece protrudes out of the hole in the cover element in the longitudinal direction (L) at least in part, the channel systems in particular leading into a side face of the hole such that a hole of the cover element can be made to overlap one opening of the mouthpiece in each case, so as to make it possible to establish at least one continuous fluidic connection between each chamber and the mouthpiece.

4. The device according to claim 3 wherein at least one channel system leads into the mouthpiece laterally, in a direction (V) that is transverse to the longitudinal direction (L).

5. The device according to claim 1 wherein at least one channel system leads into the mouthpiece laterally, in a direction (V) that is transverse to the longitudinal direction (L).

6. The device according to claim 1 wherein the adjustment mechanism is a mechanical adjustment mechanism that when pressed, causes the mouthpiece to rotate about the longitudinal direction (L) and/or causes a cover element to rotate about the longitudinal direction (L).

7. The device according to claim 6, wherein the adjustment mechanism is an adjustment knob.

8. The device according to claim 1 wherein, the adjustment mechanism comprises an electric motor that causes the mouthpiece to rotate about the longitudinal direction (L) and/or causes a cover element to rotate about the longitudinal direction (L).

9. The device according to claim 1 wherein said device is designed to be portable, and in particular has a maximum extension in the longitudinal direction (L) of at most 15 cm, and a maximum width in a direction (V) transverse to the longitudinal direction (L) of at most 6 cm.

10. The device according to claim 1, wherein a cover element comprises at least one hole which is continuous in the longitudinal direction (L) and in which the mouthpiece can be placed such that the mouthpiece protrudes out of the hole in the cover element in the longitudinal direction (L) at least in part, the channel systems in particular leading into a side face of the hole such that a hole of the cover element can be made to overlap one opening of the mouthpiece in each case, so as to make it possible to establish at least one continuous fluidic connection between each chamber and the mouthpiece.

11. The device according to claim 1, wherein the channel systems are formed in a common cover element, it being possible for the cover element to be releasably mounted on the housing.

12. The device according to claim 11, wherein, the cover element comprises at least one hole which is continuous in the longitudinal direction (L) and in which the mouthpiece can be placed such that the mouthpiece protrudes out of the hole in the cover element in the longitudinal direction (L) at least in part, the channel systems in particular leading into a side face of the hole such that a hole of the cover element can be made to overlap one opening of the mouthpiece in each case, so as to make it possible to establish at least one continuous fluidic connection between each chamber and the mouthpiece.

13. The device according to claim 11 wherein at least one channel system leads into the mouthpiece laterally, in a direction (V) that is transverse to the longitudinal direction (L).

14. The device according to claim 1 wherein at least one channel system leads into the mouthpiece laterally, in a direction (V) that is transverse to the longitudinal direction (L).

15. The device according to claim 1 wherein the fluidic connections are blockable.

16. The device according to claim 1 wherein said device has a maximum extension in the longitudinal direction (L) of at most 10 cm or has a maximum width in a direction (V) transverse to the longitudinal direction (L) of at most 4 cm.

17. Device for producing and inhaling smoke, in particular an e-cigarette for producing and inhaling smoke, comprising:

at least two chambers, installed in an in particular portable housing, and the two chambers are arranged adjacently to one another in a direction (V) that is transverse to the longitudinal direction (L), each of the chambers being fluidically connected to the mouthpiece by means of a channel system formed in a common cover element, it being possible for the cover element to be releasably mounted on the housing 41 that can in particular be blocked at least in part, that are each designed and intended for receiving a smoking product, for example tobacco or a liquid to be vaporised, at least one means for receiving smoke formed inside the chambers, the means being fluidically connected to the two chambers and also to a mouthpiece for inhaling the smoke, wherein the means for receiving smoke comprises at least one adjustment mechanism, a through-flow cross section with respect to each chamber and/or with respect to the mouthpiece being adjustable by means of the adjustment mechanism, such that, either, one of the two smoking products can be inhaled by a user as desired, or both smoking products can be inhaled at the same time.

18. The device according to claim 17 wherein said device has a maximum extension in the longitudinal direction (L) of at most 10 cm or has a maximum width in a direction (V) transverse to the longitudinal direction (L) of at most 4 cm.

19. The device according to claim 18, wherein, the cover element comprises at least one hole which is continuous in the longitudinal direction (L) and in which the mouthpiece can be placed such that the mouthpiece protrudes out of the hole in the cover element in the longitudinal direction (L) at least in part, the channel systems in particular leading into a side face of the hole such that a hole of the cover element can be made to overlap one opening of the mouthpiece in each case, so as to make it possible to establish at least one continuous fluidic connection between each chamber and the mouthpiece.

20. The device according to claim 18 wherein at least one channel system leads into the mouthpiece laterally, in a direction (V) that is transverse to the longitudinal direction (L).

* * * * *